United States Patent [19]

Wood, Jr.

[11] Patent Number: 4,651,888

[45] Date of Patent: Mar. 24, 1987

[54] SAFETY CAP FOR PRESSURIZED CYLINDERS

[75] Inventor: Theodore N. Wood, Jr., Harveys Lake, Pa.

[73] Assignee: The Eastern Pennsylvania Co., Inc., Wilkes-Barre, Pa.

[21] Appl. No.: 837,366

[22] Filed: Mar. 7, 1986

Related U.S. Application Data

[63] Continuation-in-part of Ser. No. 817,485, Jan. 9, 1986.

[51] Int. Cl.[4] ..... B65D 41/06

[52] U.S. Cl. ..... 220/85 P; 137/382

[58] Field of Search ..... 220/85 P, 3, 323, 324, 220/326, DIG. 20; 137/377, 382

[56] References Cited

U.S. PATENT DOCUMENTS

| | | | |
|---|---|---|---|
| 104,884 | 2/1870 | Reinshagen . | |
| 207,979 | 4/1878 | Pearson . | |
| 235,279 | 3/1880 | Norton . | |
| 1,216,869 | 2/1917 | Snigo . | |
| 1,833,924 | 12/1931 | Wayer | 137/382 |
| 1,948,953 | 2/1934 | Wayer et al. . | |
| 2,201,521 | 5/1940 | Cook et al. | 220/85 P |
| 2,216,717 | 10/1940 | Alessio . | |
| 3,185,336 | 5/1965 | Goss | 220/85 P |
| 3,696,964 | 10/1972 | Deakin . | |
| 3,706,401 | 12/1972 | Gach . | |
| 3,831,802 | 8/1974 | Chambers et al. | 137/382 X |
| 4,279,355 | 7/1981 | Schwartz et al. . | |
| 4,491,060 | 1/1985 | Boski . | |

FOREIGN PATENT DOCUMENTS

| | | |
|---|---|---|
| 84821 | 3/1895 | Fed. Rep. of Germany . |
| 750819 | 1/1945 | Fed. Rep. of Germany . |

*Primary Examiner*—Steven M. Pollard

*Attorney, Agent, or Firm*—Burns, Doane, Swecker & Mathis

[57] ABSTRACT

A pressurized cylinder has a cap mounted thereto. The cap has a skirt wall of corrugated configuration to form a plurality of radially inwardly opening channels which alternate circumferentially with radially outwardly opening channels. A plurality of coplanar, circumferentially extending grooves or slits are formed in the outwardly open channels so as to extend radially completely therethrough. The cap is inserted longitudinally onto the cylinder such that a plurality of tabs carried by the cylinder travel longitudinally within the radially inwardly open channels. Thereafter, the cap is rotated such that the tabs enter the grooves to prevent longitudinal removal of the cap. A yieldable latch locks the cap in its secured position.

19 Claims, 16 Drawing Figures

Fig. 4
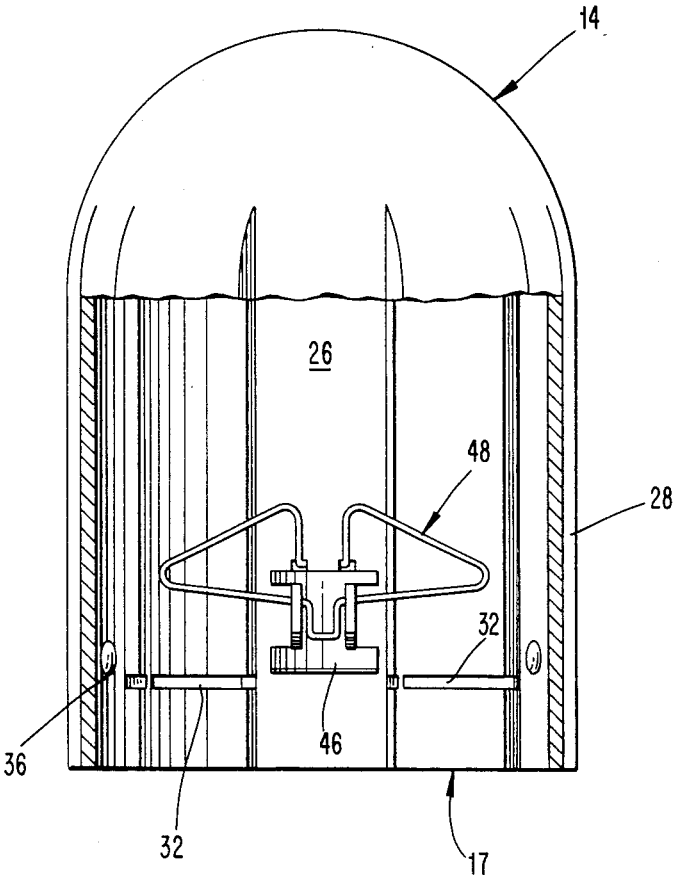
Fig. 5
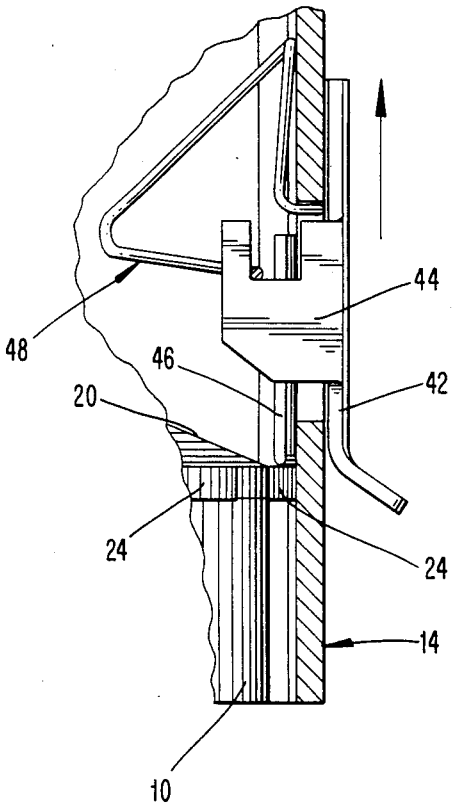
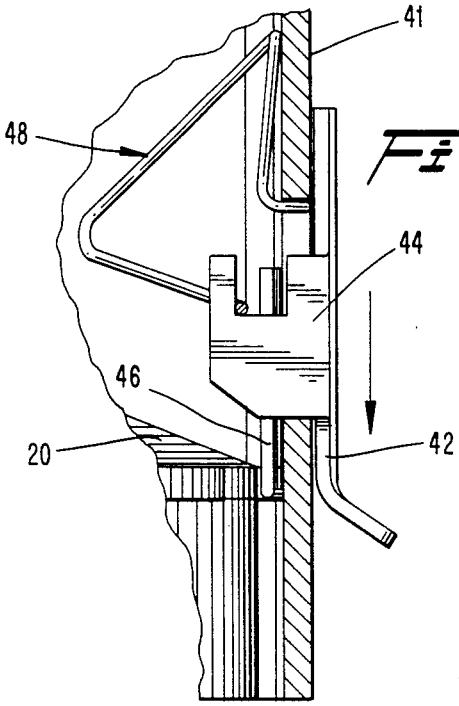
Fig. 6
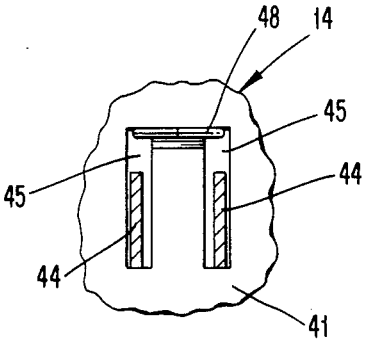
Fig. 7

SAFETY CAP FOR PRESSURIZED CYLINDERS

RELATED INVENTION

This is a Continuation-in-Part of the present inventor's copending U.S. application Ser. No. 06/817,485 filed Jan. 9, 1986.

BACKGROUND AND OBJECTS OF THE INVENTION

The present invention relates to pressurized cylinders and, in particular, to protective caps for pressurized cylinders.

Cylinders containing pressurized fluids, such as oxygen and flammable gases for example, are provided at one end with a valved discharge opening. Protection of the valve is of major concern because a rupturing of the valve (resulting for example from a severe impact) may produce serious harm since the cylinders are highly pressurized (e.g., cylinders commonly in use are pressurized to 5,000 psi). For that reason, it has been necessary to provide a rugged protective cap which fits atop the cylinder in overlying relation to the valve. Virtually all such caps presently in use are formed of steel and are attached to the cylinder by means of a threaded coupling (e.g., female threads on the cap which screw onto male threads on the cylinder).

While such caps have been able to meet minimum safety standards, the threaded coupling presents certain drawbacks. For example, the threads tend to rust and corrode, especially when used in corrosive atmospheres (e.g., when used offshore). Also, in the event that a cylinder is subjected to a severe impact, the threads may become distorted. In such instances, removal of the cap may become very difficult, if not impossible to achieve. It is not uncommon under such circumstances for operators to harshly handle the cylinder (e.g., by striking the cap) in attempting to break loose the threads. Such abuse can lead to a rupturing of the valve. Furthermore, since the male threads are often carried on a ring or collar fastened to the cylinder (e.g., by peening) it is possible that attempts to free a rusted thread may cause the ring to become dislodged from the cylinder, whereupon the ring remains attached to the cylinder, but is free to rotate. In that event, removal of the cap becomes virtually impossible and the cylinder is rendered unusable.

Even in cases where rusted caps are eventually removed without a rupturing of the valve, the difficulty encountered usually produces substantial amounts of wasted time and effort on the part of handlers.

Efforts to design a threadless coupling have heretofore not met with commercial success due, in large measure, to the inability of such couplings to meet the safety standards required of the caps. For example, the integrity of cap securement is tested by (1) dropping the capped end of the cylinder from ten feet onto cement in a vertical direction and also in a direction oriented at a 45° angle to vertical, and (2) toppling a standing cylinder such that the cap impacts against another cylinder lying on the ground whereby the cap of the falling cylinder takes the full impact in a direction generally perpendicular to the cylinder axis. Such impacts can be of considerable magnitude, since the cylinders can be quite heavy, e.g., on the order of 200 pounds, for example.

It has heretofore been proposed in Wayer et al U.S. Pat. No. 1,948,953 issued Feb. 27, 1934 to shorten the time required to install and remove the cap by employing a coupling comprising lugs on the cylinders which, upon subsequent rotation of the cap, become wedged against corresponding lugs on the cap. Such an arrangement which constitutes, in effect, a shortening of the extent of the standard threaded coupling between the cap and cylinder, presents certain shortcomings. For example, the wedging engagement between the lugs renders the lugs highly susceptible to being locked shut, e.g., by rust, dirt, deformation of the lugs. This possibility is apparently recognized by Wayer et al who provide a hole at the top of the cap for receiving a bar wrench to enable the cap to be rotated.

An additional problem involves a tendency for the caps to become deformed when they are dropped. Such deformation can hinder subsequent removal of the cap regardless of whether the cap is secured by threads or by a lug-type connection as described in the above-mentioned Wayer et al patent. Deformations of this nature are not uncommon, due to the relatively rough handling to which pressurized cylinders are often subjected.

It is, therefore, an object of the present invention to minimize or obviate problems of the type discussed above.

Another object is to provide a threadless coupling for pressurized cylinder caps which is easily attachable and releasable.

A further object is to provide such a threadless coupling on a cap which is highly rugged and strong so as to resist deformations.

An additional object is to provide a threadless coupling which can be latched shut and wherein an added measure of safety is provided in the event that the latch has not been secured.

BRIEF SUMMARY OF THE INVENTION

These objects are achieved by the present invention which involves a cap adapted to be removably mounted on a valved longitudinal end of a pressurized cylinder. The cylinder is of the type which includes plurality of circumferentially spaced, radially outwardly extending tabs adjacent its valved end. The cap includes a skirt wall forming longitudinally spaced closed and opened ends. The wall is of generally corrugated shape to form a series of generally longitudinally extending channels which include at least two radially inwardly open channels alternating circumferentially with at least two radially outwardly open channels. The inwardly open channels are separated from the outwardly open channels by generally longitudinally extending divider wall portions. A plurality of coplanar, circumferentially extending grooves are formed in the outwardly open channels so as to extend radially completely therethrough. Each groove extends circumferentially through at least one of the divider wall portions to communicate the groove with an adjacent one of the inwardly open channels. The inwardly open channels are distributed so as to be capable of receiving the tabs as the cap is inserted longitudinally over the valved end of the cylinder. The grooves are sized to receive the tabs in response to forward rotation of the cap with the caps lying coplanar with the grooves. The presence of the tabs projecting through the grooves serves to secure the cap to the cylinder. A releasable latch prevents rearward rotation of the cap when the tabs are disposed in the grooves.

Preferably, the divider wall portions containing the grooves are in circumferentially alternating relationship with others of the grooves which include recesses aligned with respective ones of the grooves. The recesses are arranged to be engaged by circumferentially rearward ends of respective tabs in response to rearward rotation of the cap when the tabs are aligned with the grooves. In this manner, engagement of the tabs within the recesses serves to resist longitudinal dislodgement of the cap in instances where the latch has not been secured.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 4 is a vertical sectional view taken through a cap mounted to the cylinder and depicting a latching mechanism in an upwardly displaced position;

FIG. 5 is a fragmentary vertical sectional view taken through the cap, depicting the latch in an upwardly retracted position;

FIG. 6 is a view similar to FIG. 5 depicting the latch after it has been spring-biased downwardly following a forward rotation of the cap;

FIG. 7 is an enlarged, side elevational view of slots through which the latch is mounted to the cap;

FIG. 13 depicts the position of the cap after it has been longitudinally slid onto the cylinder;

FIG. 14 depicts the position of the cap after it has been partially rotated in a forward direction;

FIG. 15 depicts the position of the cap after the cap has been fully rotated to a secured position.

DETAILED DESCRIPTION OF A PREFERRED EMBODIMENT OF THE INVENTION

Figure 1:
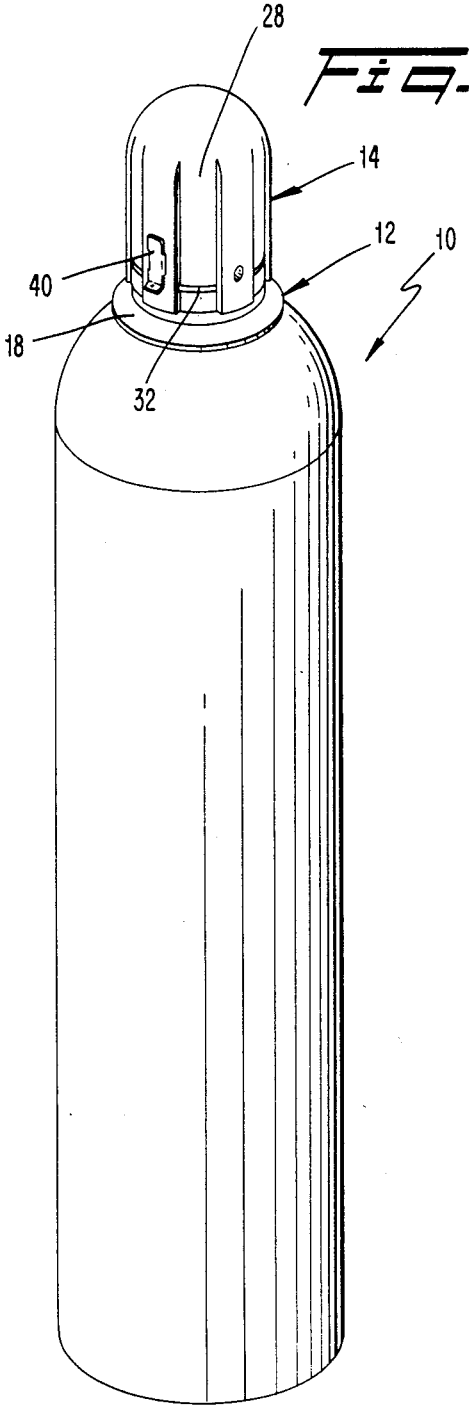
FIG. 1 is a side elevational perspective view of a pressurized cylinder containing a safety cap according to the present invention.
Figure 2:
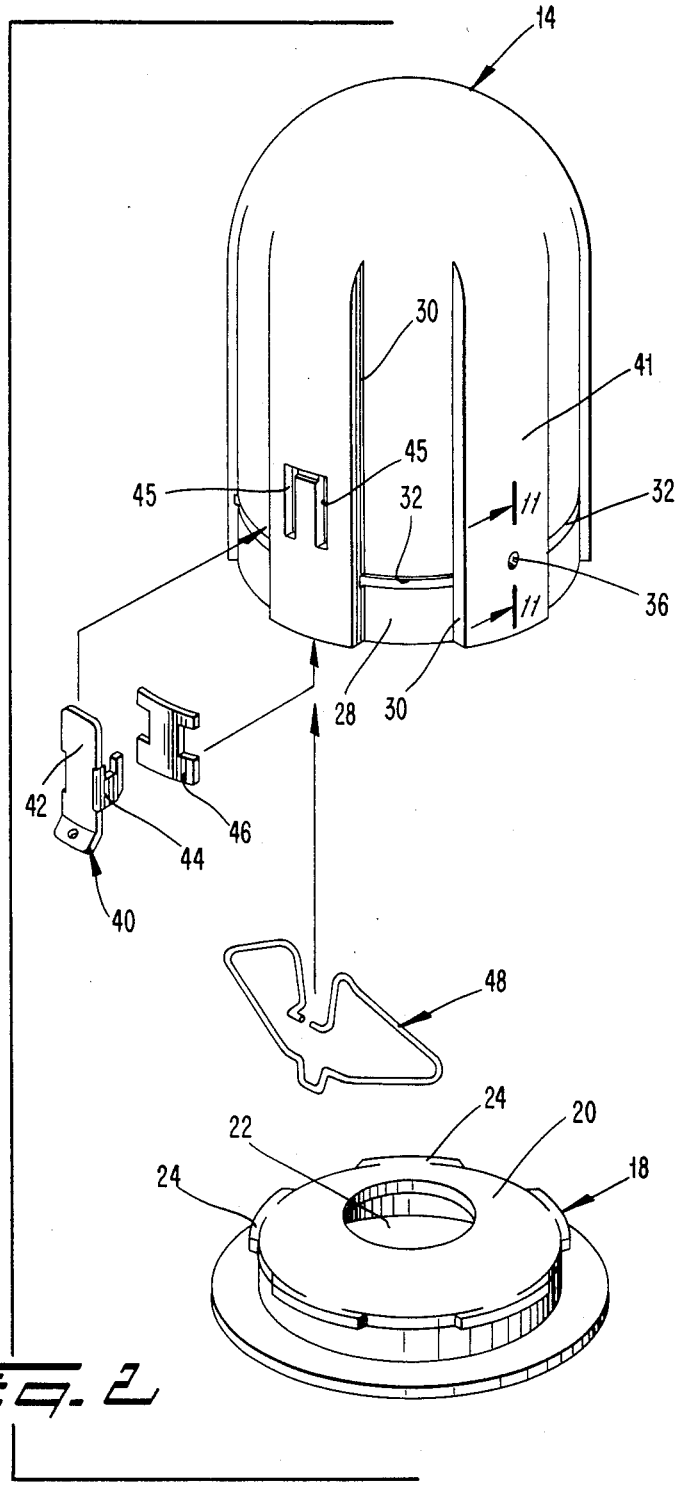
FIG. 2 is a perspective view exploded view of the cap.
Figure 3:
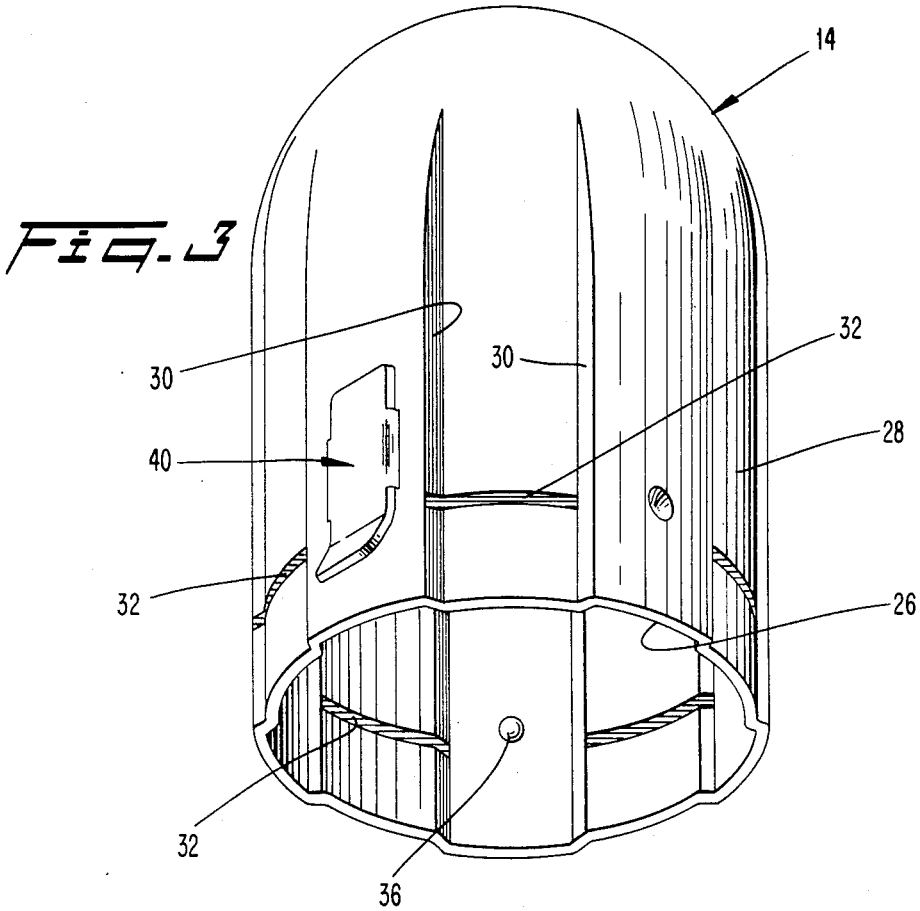
FIG. 3 is a bottom perspective view of the cap.

Depicted in FIG. 1 is a pressurized cylinder 10 adapted to carry pressurized fluid. Secured to a valved end 12 of the cylinder is a safety cap 14 according to the present invention. The cap is dome-shaped and formed of any suitable material, such as steel for example, which is sufficiently impact-resistant to meet minimum safety standards.

The cap may contain vent holes (not shown) and has an open end 17 sized to fit over the valved end of the cylinder to encompass the valve. Securement of the cap to the cylinder is achieved by means of quick-release/-connect coupling in accordance with the present invention.

The cylinder carries a ring or collar 18 which is fixed to the cylinder against rotation about the longitudinal axis of the cylinder. The collar includes a longitudinally facing convex surface 20 which has a central hole 22 through which the valve extends. The collar also includes a plurality of circumferentially spaced, radially outwardly projecting tabs 24. Preferably, there are five such tabs 24, the total circumferential length of which is just under 180°.

The cap is press-formed of steel and is formed such that the skirt thereof is of constant thickness and is corrugated so as to comprise a plurality of longitudinally extending, radially inwardly facing channels 26 alternating circumferentially with a plurality of longitudinally extending, radially outwardly facing channels 28. Adjacent channels 26,28 share a common longitudinal divider wall 30. The inwardly facing channels 26 are open at the open end 17 of the cap and are dimensioned in the circumferential direction so as to be suitable for receiving the tabs 24 of the ring 18 as the cap is inserted longitudinally thereover. Thus, the quantity of the inwardly open channels 26 corresponds to that of the tabs 24.

Figure 13:
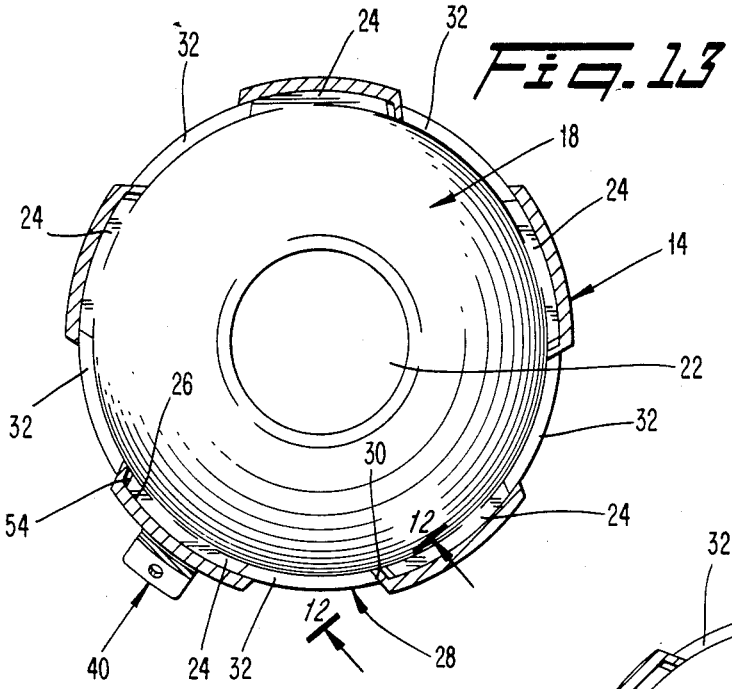
FIGS. 13, 14 and 15 are sectional views taken along the line 15—15 in FIG. 10 and depicting various positions of the cap as the cap is being secured to the pressurized cylinder.
Figure 14:
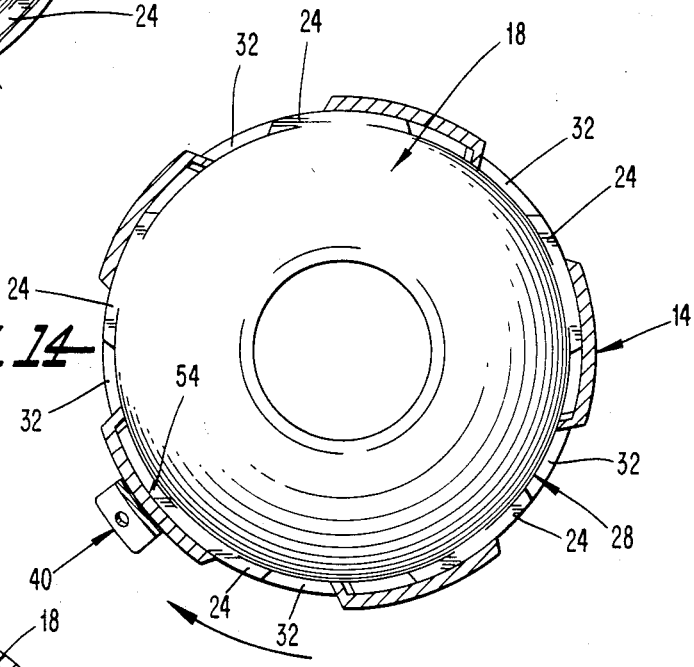
Figure 15:
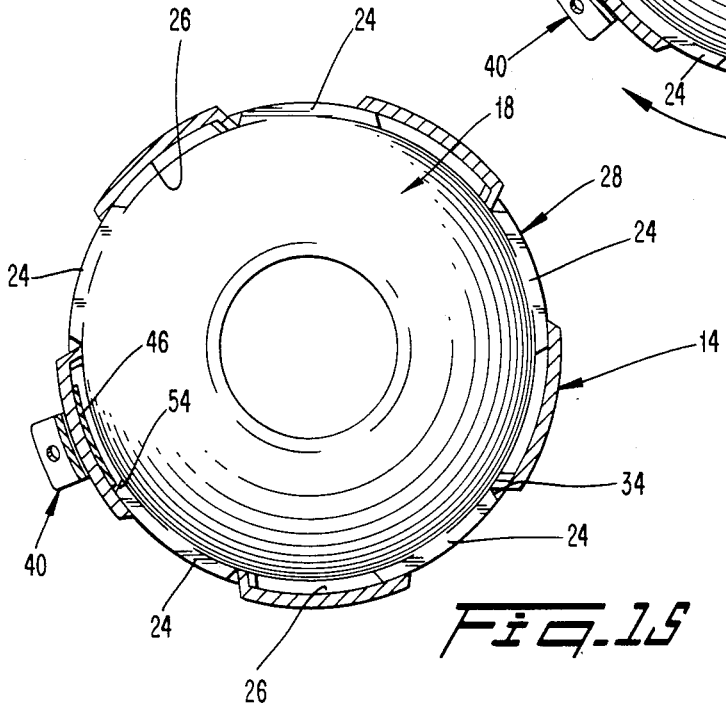

Each of the outwardly facing channels 28 includes a circumferentially extending groove or slit 32 extending completely radially through the skirt of the cap. The width of each groove, i.e., a dimension parallel to the longitudinal axis of the cap, is sized slightly larger than the corresponding dimension of the tabs 24. Each groove extends through one of the longitudinal divider walls 30 located at the ends of the groove so as to provide communication between the outward channel 28 and one of the adjacent inward channels 26. The grooves 32 extend circumferentially and are mutually coplanar. The arrangement is such that when the cap 14 is inserted over the ring 18 with the inward channels 26 aligned with the tabs 24, the tabs 24 travel longitudinally inwardly along the inward channels 26 (see FIG. 13). If the cap is subsequently rotated forwardly about its longitudinal axis when the tabs 24 lie in the plane of the grooves 32 (FIG. 14), the tabs 24 will enter respective ones of the grooves 32 to secure the cap to the ring. Circumferentially forward ends 34 of the tabs 24 will abut the non-grooved ones of the divider walls 30 at the closed ends of the grooves (FIG. 15).

Figure 11:
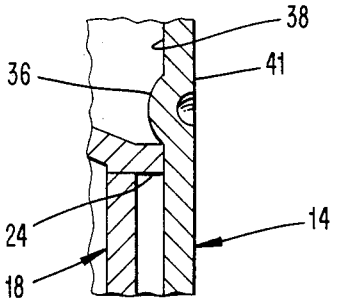
FIG. 11 is a sectional view taken along the line 11—11 in FIG. 2.

In order to locate the tabs 24 in the plane of the grooves 32 as the cap is inserted onto the cylinder, the cap is provided with suitable stops, such as projections 36 extending radially inwardly from the internal surfaces 38 of at least some of the inward channels (FIG. 11). Those projections can be formed by an inward punching or peening of the external surface 41 of the respective inward channels 26, whereby the internal surface 38 of those channels is deformed inwardly to form the inward protrusions 36. The protrusions 36 are located at the upper boundary of the plane containing the coplanar grooves 32 so that the tabs 24 contact the protrusions 36 when the cap 14 is being installed.

Mounted on one of the inward channels 26 is a latching mechanism 40 for locking the cap in its secured position. The latching mechanism 40 is essentially the same as that disclosed in parent application Ser. No.

06/817,485, the disclosure of which is incorporated by reference herein. Basically, the latching mechanism 40 comprises a slide 42 which is disposed on the outside surface 41 opposite one of the inwardly facing channels 26. The slide includes a pair of arms 44 which project through a pair of slits 45 in the skirt, the arms being vertically slidable therein. The arms carry a latching element 46 which is slidable vertically along the inside surface 38 of the channel 26. A spring 48 biases the slide 42 downwardly. When the cap is inserted onto the cylinder 10, the lower edge of the latching element engages the top surface 20 of the associated tab 24 and is pushed upwardly against the bias of the spring 48 (see FIG.5). When the cap is thereafter rotated so as to cause the tab to enter one of the slots 32 and thereby egress from the inwardly facing channel 26, the slide and latching element are displaced downwardly by the spring 48 (see FIG. 6 and the broken line position of FIG. 4), whereby the latching element becomes situated circumferentially adjacent the tab in order to prevent return rotation of the cap until the latch is manually raised.

Figure 12:
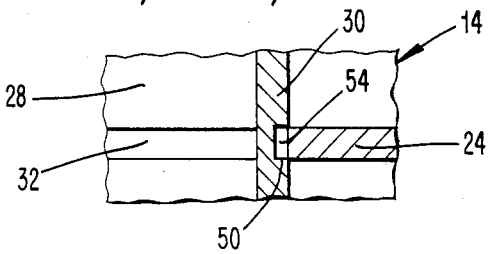
FIG. 12 is a cross-sectional view taken along the line 12—12 in FIG. 13.

The ones of the divider walls 30 through which the grooves 32 do not extend are provided with recesses 50 disposed in the common plane of the grooves 32 as depicted in FIG. 12. The function of the recess 50 is to provide a certain measure of safety in the event that the cylinder is being handled with the latching mechanism inadvertently in a non-latched condition. That is, cylinders may be carried by an operator who grips the side of the cap and rolls the cylinder along its bottom edge. If the cap is unlatched and free to rotate, the tabs 24 may slide out of the grooves, whereupon a danger exists that the cap 14 may become dislodged from the cylinder 10. By providing the recesses 50, however, there will occur a tendency for the circumferentially rearward ends 52 of the tabs 24 to enter the recesses 50 especilly if the cylinder is being rolled in the above-described manner, whereupon the engagement between the tabs and recesses will provide a certain amount of resistance to the dislodgement of the cap. The rear ends 54 of the tabs can be sized to fully enter the recess as depicted in FIG. 12, or those rear ends can be oversized and tapered so as to provide a wedging action within the recess.

Figure 16:
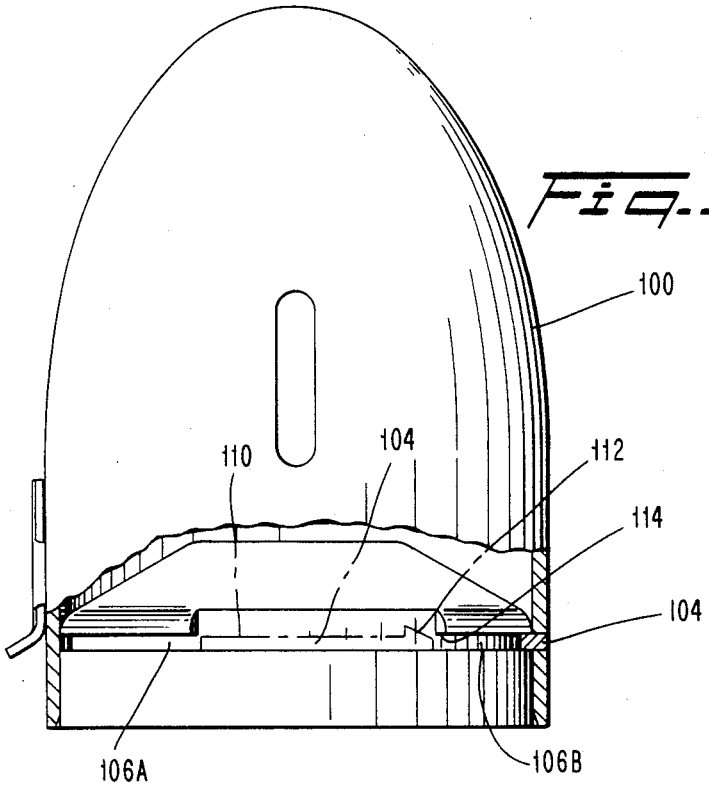
FIG. 16 is a side elevational view, partly broken away, of a modified form of the invention, depicting the position of the cap after it has been longitudinally slid onto the ring.
Figure 8:
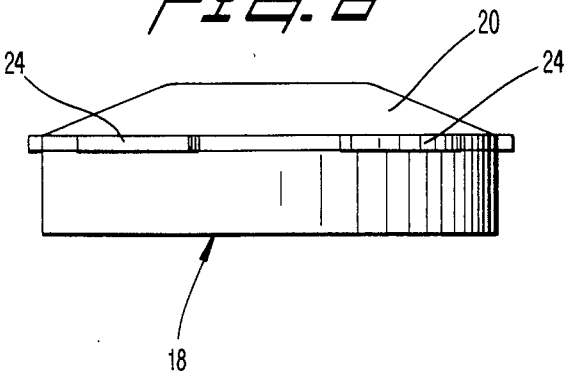
FIG. 8 is a side elevational view of a ring which is to be secured to the pressurized cylinder.
Figure 9:
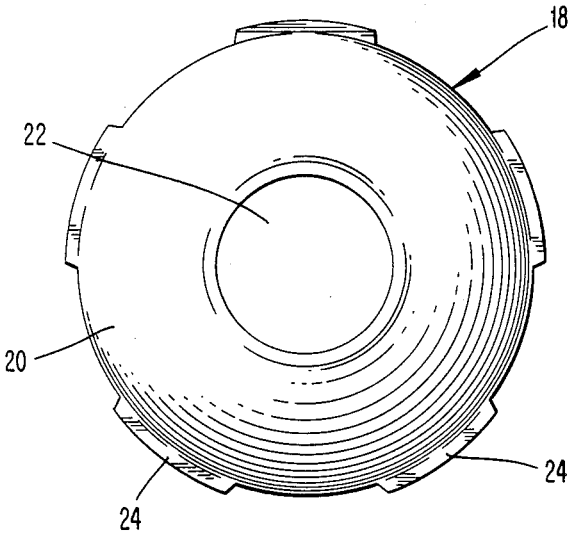
FIG. 9 is a top plan view of the ring of FIG. 8.
Figure 10:
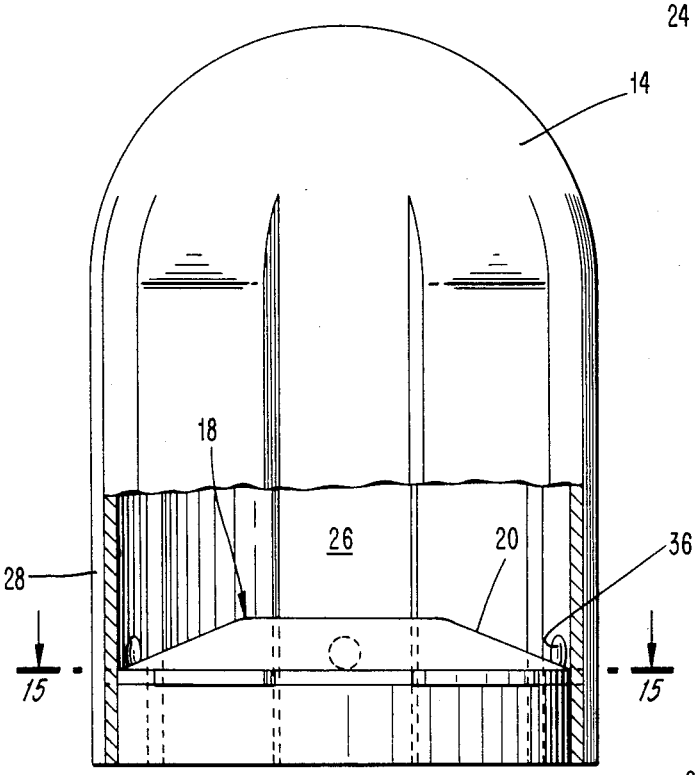
FIG. 10 is a side elevational view of the cap mounted to the ring, with a bottom portion of the cap being broken away.

Such a safety mechanism can also be employed in connection with the invention disclosed in parent application Ser. No. 06/817,485. As depicted in FIG. 16 herein, that invention involves an arrangement of a cap 100 mounted on a pressurized cylinder 102, wherein the cap carries circumferentially spaced, radially outwardly projecting tabs 104, and the cylinder carries circumferentially extending grooves 106 and longitudinal channels 108 through which the tabs 104 pass to become aligned with the grooves 106. The tab 104 depicted in phantom lines in FIG. 16 has a circumferentially forward end 110 which enters a groove 106A during the normal securing operation, and a circumferentially rearward end 112. Aligned with the groove 106A is a recess 106B in the cylinder, the recess being defined by another one of the grooves. The recess 106 is engaged by the circumferentially rearward end 112 of the respective tab 104 in response to rearward rotation of the cap. That tab rearward end 112 is tapered, such that the tapered face wedgingly engages a corner 114 of the recess 106B. Alternatively, the rearward end could be sized of the same width as the recess as described previously in connection with FIG. 12. In any event, the engagement of the rearward end 112 of the tab within the recess 106B will resist the longitudinal dislodgement of the cap.

IN OPERATION, the cap 14 is mounted on a cylinder 10 by aligning the tabs 24 with the radially inwardly facing channels 26 of the cap. The cap is longitudinally installed onto the cylinder, whereupon the tabs 24 travel through the channels 26 and abut the stops 36. In this position, the tabs 24 are coplanar with the grooves or slits 32. Also, the latching element 46 will have been contacted by the surface 20 of the ring, i.e., by an upper surface of one of the tabs 24, and will have been displaced upwardly against the bias of the spring 48. Upon subsequent forward rotation of the cap 14, the tabs 24 enter the grooves 32 in order to retain the cap against longitudinal movement. Forward rotation of the cap continues until the latching element 46 rides off of the tab 24 upon which it has been riding and is biased downwardly to a position between two of the tabs. Accordingly, the latching element restricts forward and rearward rotation of the cap.

It may occur that an operator will attempt to carry a cylinder when the latch has not been properly secured. That is, cylinders may be carried by an operator who grips the side of the cap and rolls the cylinder along its bottom edge. If the cap is unlatched and free to rotate, the tabs may slide out of the grooves, whereupon a danger exists that the cap may become dislodged from the cylinder. However, in accordance with the present invention, rearward rotation of the cap may result in the rearward ends 54 of the tabs being received in the recesses 50 formed in some of the divider walls 30. If that occurs, inadvertent dislodgement of the cap will be resisted.

If the latch has been properly secured, an operator may remove the cap by applying an upward force to the slide 42 in order to raise the latching element to an elevation above the tabs 24. By simultaneously exerting a rearward rotation to the cap, the radially inwardly facing channels 26 can be brought into alignment with the tabs 24, whereupon the cap can be removed in response to subsequent longitudinal lifting of the cap.

The shaping of the cap in corrugated fashion so as to define alternating outwardly and inwardly facing channels separated by longitudinal divider walls results in a very strong, impact-resistant cap which resists deformations in both the longitudinal and radial directions.

The tabs are relatively loosely received in the grooves so as to minimize chances for the tabs to become rusted shut. Furthermore, the fact that the grooves or slits extend radially completely through the cap enables any dirt or rust present in the groove to be expelled from the groove rather than hindering, or possibly preventing, rotation of the cap.

The presence of recesses in the divider walls which are adapted to receive rearward ends of the tabs when the latch has not been properly secured, provides an added measure of safety for resisting dislodgement of the cap.

Although the present invention has been described in connection with a preferred embodiment thereof, it will be appreciated by those skilled in the art that modifications, additions, substitutions, and deletions not specifically described, may be made, without departing from the spirit and scope of the invention as defined in the appended claims.

What I claim is:

1. A pressurized cylinder having a cap removably mounted on a valved longitudinal end of said cylinder;

said cylinder including a plurality of circumferentially spaced, radially outwardly extending tabs adjacent said valved end;

said cap including a skirt wall forming longitudinally spaced closed and open ends, said wall being of generally corrugated shape to form a series of generally longitudinally extending channels including at least two radially inwardly open channels alternating circumferentially with at least two radially outwardly open channels, said inwardly open channels being separated from said outwardly open channels by generally longitudinally extending divider wall portions, a plurality of coplanar, circumferentially extending grooves formed in said outwardly open channels so as to extend radially completely therethrough, each groove extending circumferentially through at least one of said divider wall portions to communicate said groove with an adjacent one of said inwardly open channels, said inwardly open channels being distributed so as to be capable of receiving said tabs as said cap is inserted longitudinally over said valved end of said cylinder, said grooves being sized to receive said tabs in response to forward rotation of said cap with said tabs lying coplanar with said grooves, the presence of said tabs projecting through said grooves serving to secure said cap to said cylinder, and releasable latching means for preventing rearward rotation of said cap when said tabs are disposed in said grooves.

2. Apparatus according to claim 1, wherein said skirt wall is of constant thickness.

3. Apparatus according to claim 1, wherein there are five said tabs, five said inwardly facing channels, and five said outwardly facing channels.

4. Apparatus according to claim 1, wherein said cap is formed of pressed steel.

5. Apparatus according to claim 1, wherein said latching means is spring-biased to a latching position.

6. Apparatus according to claim 1, wherein said cap includes stop means for positioning said tabs in circumferential alignment with said grooves when said cap is inserted longitudinally onto said cylinder.

7. Apparatus according to claim 1, wherein said divider wall portions containing said grooves are in circumferentially alternating relationship with others of said grooves which include recesses aligned with respective ones of said grooves, said recesses arranged to be engaged by circumferentially rearward ends of respective tabs in response to rearward rotation of said cap when said tabs are aligned with said grooves, to resist longitudinal dislodgement of said cap in instances where said latching means has not been secured.

8. A cap securable to a valved end of a pressurized cylinder of the type comprising a plurality of circumferentially spaced, radially outwardly projecting tabs, said cap including a skirt wall forming longitudinally spaced open and closed ends, said wall being of generally corrugated shape to form a series of generally longitudinally extending channels including at least two radially inwardly open channels alternating circumferentially with at least two radially outwardly open channels, said inwardly open channels being separated from said outwardly open channels by generally longitudinally extending divider wall portions, a plurality of coplanar, circumferentially extending grooves formed in said outwardly open channels so as to extend radially completely therethrough, each groove extending circumferentially through one of said divider wall portions to communicate said groove with an adjacent one of said inwardly open channels, said inwardly open channels being distributed so as to be capable of receiving said tabs as said cap is inserted longitudinally over said valved end of said cylinder, said grooves being sized to receive said tabs in response to forward rotation of said cap with said tabs lying coplanar with said grooves, the presence of said tabs projecting through said grooves serving to secure said cap to said cylinder, and releasable latching means for preventing rearward rotation of said cap when said tabs are disposed in said grooves.

9. Apparatus according to claim 8, wherein said skirt wall is of constant thickness.

10. Apparatus according to claim 8, wherein there are five said tabs, five said inwardly facing channels, and five said outwardly facing channels.

11. Apparatus according to claim 8, wherein said cap is formed of pressed steel.

12. Apparatus according to claim 8, wherein said latching means is spring-biased to a latching position.

13. Apparatus according to claim 8, wherein said cap includes stop means for positioning said tabs in circumferential alignment with said grooves when said cap is inserted longitudinally onto said cylinder.

14. Apparatus according to claim 8, wherein said divider wall portions containing said grooves are in circumferentially alternating relationship with others of said grooves which include recesses aligned with respective ones of said grooves, said recesses arranged to be engaged by circumferentially rearward ends of respective tabs in response to rearward rotation of said cap when said tabs are aligned with said grooves, to resist longitudinal dislodgement of sid cap in instances where said latching means has not been secured.

15. A pressurized cylinder having a cap removably mounted at a valved end of said cylinder, one of said cap and cylinder carrying a plurality of circumferentially spaced, radially projecting tabs, the other of said cap and cylinder including a plurality of circumferentially spaced, circumferentially extending grooves, and a plurality of longitudinally extending channels communicating with said grooves to permit said tabs to pass longitudinally within said channels when said cap is inserted longitudinally onto said cylinder and then pass circumferentially forwardly into said grooves when said cap is rotated in a forward direction, whereupon said cap is secured to said cylinder;

releasable latching means for preventing rearward rotation of said cap to a non-secured position from said secured position;

said other of said cap and said cylinders including a plurality of recesses each positioned in circumferential alignment with a rear end of a respective groove and arranged to be engaged by a circumferentially rearward end of a respective tab in response to rearward rotation of said cap when said tabs are aligned with said grooves, to resist longitudinal dislodgement of said cap in instances where said latching means is not secured.

16. Apparatus according to claim 15, wherein said recesses are carried by said cap.

17. Apparatus according to claim 15, wherein said recesses are carried by said cylinder.

18. Apparatus according to claim 17, wherein said recesses comprise forward ends of said grooves.

19. Apparatus according to claim 15, wherein said rearward ends of said tabs are inclined so as to wedgingly engage said recesses.

* * * * *